US006943757B2

(12) United States Patent
Huang et al.

(10) Patent No.: US 6,943,757 B2
(45) Date of Patent: Sep. 13, 2005

(54) METHOD FOR DRIVING A PLASMA DISPLAY PANEL

(75) Inventors: Jih-Fon Huang, Hsin-Chu Hsien (TW); Yi-Min Huang, Hsin-Chu (TW); Shin-Tai Lo, Miao-Li Hsien (TW)

(73) Assignee: AU Optronics Corp., Hsin-Chu (TW)

( * ) Notice: Subject to any disclaimer, the term of this patent is extended or adjusted under 35 U.S.C. 154(b) by 302 days.

(21) Appl. No.: 10/064,674

(22) Filed: Aug. 6, 2002

(65) Prior Publication Data

US 2003/0122735 A1 Jul. 3, 2003

(30) Foreign Application Priority Data

Dec. 28, 2001 (TW) ..... 90132993 A

(51) Int. Cl.[7] ..... G09G 3/10; G09G 3/28; G09G 3/30; G09G 5/00

(52) U.S. Cl. ..... 345/60; 345/76; 345/211; 315/169.1; 315/169.3

(58) Field of Search ..... 345/60, 76, 211; 315/169.1, 169.3

(56) References Cited

U.S. PATENT DOCUMENTS 4,070,663 A * 1/1978 Kanatani et al. ..... 345/76
5,133,141 A * 7/1992 Bane ..... 40/593
5,808,420 A * 9/1998 Rilly et al. ..... 315/169.4
6,011,355 A * 1/2000 Nagai ..... 315/169.3
6,150,999 A * 11/2000 Chen et al. ..... 345/60
6,160,531 A * 12/2000 Chen et al. ..... 345/60
6,175,192 B1 1/2001 Moon
6,628,275 B2 * 9/2003 Vossen et al. ..... 345/211
2002/0030642 A1 * 3/2002 Huang et al. ..... 345/60
2003/0090440 A1 * 5/2003 Marcotte ..... 345/60

* cited by examiner

*Primary Examiner*—Bipin Shalwala
*Assistant Examiner*—David L. Lewis
(74) *Attorney, Agent, or Firm*—Winston Hsu

(57) ABSTRACT

A method for driving a plasma display panel (PDP). The PDP includes a first electrode and a second electrode. Initially provide the first electrode with a first voltage V1. Next, provide the second electrode with a second voltage V2 that is higher than the first voltage V1 during a first time interval. Then, provide the second electrode a third voltage V3 that is lower than the first voltage V1 during a second time interval. In the first time interval, a first voltage difference D1 between the first electrode and the second electrode equals the second voltage V2 minus the first voltage V1. During the second time interval, a second voltage difference D2 between the first electrode and the second electrode equals the third voltage V3 minus the first voltage V1.

10 Claims, 16 Drawing Sheets

METHOD FOR DRIVING A PLASMA DISPLAY PANEL

BACKGROUND OF INVENTION

1. Field of the Invention

The present invention relates to a driving method for a plasma display panel (PDP) during a sustain period, and more particularly, to a driving method capable of simplifying the electrical devices required by a plasma display panel during a sustain period.

2. Background of the Invention

A plasma display panel contains an inert gas sealed within a plurality of plasma display units disposed in a matrix. A driving circuit follows a sequence causing the plasma display units to excite and ionize the dischargeable gas to emit light through its discharge. The circuit characteristics of the PDP are closely equivalent to a capacitor-like load. The driving method is to impose a high voltage and high frequency alternating current (AC) on both ends of the capacitor-like load so that the charges in the plasma display unit are driven back and forth. Fluorescent agents in the display cells will absorb the ultraviolet light radiated during the driving procedure and emit visible light.

Please refer to FIG. 1. FIG. 1 is a schematic diagram of a prior art PDP 10. The PDP 10 comprises a back substrate 12 and a parallel, transparent front substrate 14. A plurality of sustain electrode pairs 16 are disposed under the front substrate 14. Each sustain electrode pair 16 includes sustain electrodes 18, 19 and each of the sustain electrodes 18, 19 is a bar of a constant width. A dielectric layer 20 is located under the front substrate 14 and covers the sustain electrode pairs 16. The dielectric layer 20 is utilized for providing a capacitance to prevent electric breakdown during alternating current (AC) driving. A passivation layer 22, usually made of magnesium oxide (MgO), is formed under the dielectric layer 20 for protecting the dielectric layer 20 from sputtering of plasma. A plurality of ribs 24 is located on the back substrate 12. A plurality of data electrodes 26 is disposed between the ribs 24. Blue phosphor 30B, red phosphor 30R, and green phosphor 30G are formed between the ribs 24 and above the data electrodes 26. Additionally, a discharging gas is sealed between the two adjacent ribs 24. The ribs 24 prevent the plasma on one side of the rib 24 from communicating with the plasma on the other side of the rib 24.

The sustain electrodes 18, 19 of the PDP 10 are called an X sustain electrode and a Y sustain electrode. The X sustain electrode 18 and the Y sustain electrode 19 are approximately transparent conductors with a larger width. The X and Y sustain electrodes 18, 19 are usually made of indium tin oxide (ITO), and are used to initiate and sustain a discharge. Additionally, the X and Y sustain electrodes 18, 19 comprise bus electrodes 36 and 38 respectively, located under the X and Y sustain electrodes 18, 19. The bus electrodes 36, 38 are opaque metal conductors with a narrower width. The bus electrodes 36, 38 are usually made of a chromium-copper-chromium (Cr—Cu—Cr) metal layer and are used to support the X and Y sustain electrodes 18, 19 to initiate a discharge and reduce the resistance of the X and Y sustain electrodes 18, 19.

As shown in FIG. 1, two adjacent ribs 24 and the sustain electrode pair 16 define a sub-pixel unit 32B, a sub-pixel unit 32R, or a sub-pixel unit 32G. The sub-pixel units 32B, 32R, 32G constitute a pixel unit 34. The sub-pixel units 32B, 32R, 32G and the pixel 34 are regions under the dotted lines as shown in FIG. 1. When supplying the X and Y sustain electrodes 18, 19 and the data electrodes 26 of the sub-pixel units 32B, 32R, 32G with a driving voltage, an electric field is formed to initiate a discharge of ionized gas to produce ultraviolet light, which irradiates the phosphors 30B, 30R, 30G to emit light.

Please refer to FIG. 2. FIG. 2 is a time sequence diagram of driving the PDP 10. In the PDP 10, a series of driving pulses are applied to each pixel unit through a predetermined normal driving procedure to form a set of image display pulses for displaying images. Taking the pixel unit 34 shown in FIG. 1 as an example, the normal driving procedure can be divided into a reset period, an address period, and a sustain period. When the pixel unit 34 is in the reset period, a voltage is applied to the X and Y sustain electrodes 18, 19. A main purpose of the reset period is to make statuses of wall charges on the surface of the sustain electrodes identical, which allows image data to be correctly written into predetermined addresses during the following address period. Then, the inert gas in the PDP 10 is excited and ionized to discharge, emitting light for displaying images. Because the inert gas is ionized, the pixel units of the PDP 10 are on a stable and excitable status. Prior art driving methods of the address period and the sustain period are well known to those skilled in the art so they are not described here. By repeating each period of the normal driving procedure, each pixel unit 34 of the PDP 10 receives different image display pulses and thus, users can see corresponding images displayed on the PDP 10. For example, a prior art driving method of a PDP in a sustain period is disclosed in U.S. Pat. No. 4,866,349, "Power Efficient Sustain Drivers AND ADDRESS FOR PLASMA PANEL". In U.S. Pat. No. OLE_Link1 4,866,349 OLE_LINK1, pulses are applied on the X and Y sustain electrodes 18, 19 to excite and ionize the inert gas to discharge and emit light.

Please refer to FIG. 3. FIG. 3 is a schematic diagram of a driving circuit 40 of the PDP 10 shown in FIG. 1. The driving circuit 40 comprises capacitors $C_1$, $C_2$, $C_p$, inductors $L_1$, $L_2$, switches $Q_1$, $Q_2$, $Q_3$, $Q_4$, $Q_5$, $Q_6$, and a power supply $V_S$, whose output voltage is V volt. The PDP 10 includes a dielectric layer 20 located between the back substrate 12 and the transparent front substrate 14, and thus producing a circuit characteristic that can be viewed as the capacitor C p formed between the sustain electrodes 18, 19. When the switch $Q_2$ is turned on, the power supply $V_S$ inputs electrical current into the capacitor $C_P$ through the switch $Q_2$. With the switch $Q_2$ turned off, the power supply $V_S$ cannot input electrical current into the capacitor $C_P$ through the switch $Q_2$. Points X, Y of the capacitor $C_P$ are connected to the sustain electrode 18 and the sustain electrode 19 respectively. The capacitors $C_1$, $C_2$, $C_P$ and inductors $L_1$, $L_2$ form a resonance circuit to make the voltages at the points X, Y of the capacitor $C_P$ oscillate. Thereby, voltages which are input into the X and Y sustain electrodes 18, 19 can be concurrently changed by the driving circuit 40 through varying the voltages of points X, Y of the capacitor $C_P$. In addition, according to a characteristic of the resonance circuit, a voltage difference between the capacitor $C_1$ and the capacitor $C_2$ is equal to a half of the output voltage of the power supply (i.e. ½V volt). As the voltage difference between the capacitor $C_1$ and the capacitor $C_2$ is not equal to a half of the output voltage of the power supply, an energy variation will occur within the resonance circuit. The detail reasons are described as follows.

Please refer to FIG. 3 and FIG. 4. FIG. 4 is a time sequence diagram of the driving circuit 40 shown in FIG. 3 during a sustain period. Before the prior art PDP 10 enters the sustain period, all of the switches $Q_1$, $Q_2$, $Q_3$, $Q_4$, $Q_5$, $Q_6$ are turned off. The voltage difference between the capacitor $C_1$ and the capacitor $C_2$ is equal to ½V volt and the voltages of both sides of the capacitor $C_P$ are zero. Then, the switches $Q_1$, $Q_5$ are turned on, making the voltage of the point X oscillate from zero to V volt, wherein ½V is the voltage of the center of oscillation. That is, the amplitude of the oscillation is equal to (½V−0) volt. Turning off the switch Q and turning on the switch $Q_2$ while the switch $Q_5$ is still turned on, makes the voltage of the point X hold at V volt. After turning on the switch $Q_1$, the switch $Q_2$ is turned off while the switch $Q_5$ is still turned on, making the voltage of the point X oscillate from V volt to zero, wherein ½V is the voltage of the center of oscillation. That is, the amplitude of the oscillation is equal to (V−½V) volt. Therefore, a pulse is produced on the point X. Then, turning off the switch $Q_5$, the switches $Q_3$, $Q_6$ are turned on making the voltage of the point Y oscillate from zero to V volt, wherein ½V is the voltage of the center of oscillation. That is, the amplitude of the oscillation is equal to (½V−0) volt. Then, turning off the switch $Q_6$, the switch $Q_4$ is turned on while the switch $Q_3$ is still turned on makes the voltage of the point Y hold at V volt. Next, turning off the switch $Q_4$, the switch $Q_6$ is turned on while the switch $Q_3$ is still turned on makes the voltage of the point Y oscillate from V volt to zero, wherein ½V is the voltage of the center of oscillation. That is, the amplitude of the oscillation is equal to (V−½V) volt. Finally, the switches $Q_3$, $Q_6$ are turned off. Therefore, a pulse is produced on the point Y. If the voltage difference between the two sides of the capacitor $C_1$ is smaller than ½V volt, the voltage of the driving circuit will be smaller than ½V volt when the switches $Q_1$, $Q_5$ are turned on to make the voltage of the point X rise. Therein the voltage of the driving circuit is supplied by the capacitor $C_1$. When the switches $Q_1$, $Q_5$ are turned off to make the voltage of the point X drop, the voltage of the driving circuit will be larger than ½V volt. Therein the voltage of the driving circuit is supplied by the voltage difference between the power supply $V_S$ and the capacitor $C_1$. Therefore, the energy output from the capacitor $C_1$ is smaller than the energy input into the capacitor $C_1$. Conversely, if the voltage difference between the two sides of the capacitor $C_1$ is larger than ½V volt, energy output from the capacitor $C_1$ is larger than the energy input into the capacitor $C_1$. Accordingly, the voltage difference between the two sides of the capacitor $C_1$ has to be equal to ½V volt in order to sustain a stable status. Similarly, the voltage difference between the two sides of the capacitor $C_2$ has to be equal to ½V volt in order to sustain a stable status. When the prior art driving circuit 40 supplies pulses to the sustain electrodes 18, 19, it has to design resonance circuits for the sustain electrodes 18, 19 respectively to produce a pulse for each of the sustain electrodes 18, 19, wherein the pulse can oscillate from zero to V volt and then oscillate from V volt to zero. As a result, the prior art PDP 10 needs many electrical devices such as capacitors, inductors, and transistors, and thus production cost is not easily reduced.

SUMMARY OF INVENTION

It is therefore a primary objective of the claimed invention to provide a driving method for driving a PDP with simplified electrical devices to reduce production cost. It is another objective of the claimed invention to provide a method for driving a PDP.

The PDP includes at least a first electrode and a second electrode. In this method, first, provide the first electrode a first voltage v1. Second, provide the second electrode a second voltage V2 that is higher than the first voltage V1 during a first time interval. Next, provide the second electrode a third voltage V3 that is lower than the first voltage V1 during a second time interval.

In the first time interval, a first voltage difference D1 between the first electrode and the second electrode equals the second voltage V2 minus the first voltage $V_1$.

During the second time interval, a second voltage difference D2 between the first electrode and the second electrode equals the third voltage V3 minus the first voltage V1.

It is an advantage of the claimed invention that only one resonance circuit is used to produce driving waveforms on a sustain electrode. It does not require another resonance circuit to produce driving waveforms on another sustain electrode in the claimed invention. In addition, the sustain electrodes can be driven to make the ionized gas discharge using a driving circuit requiring fewer electrical devices which reduces production cost.

These and other objectives and advantages of the claimed invention will no doubt become obvious to those of ordinary skill in the art after having read the following detailed description of the preferred embodiment that is illustrated in the various figures and drawings.

DETAILED DESCRIPTION

Figure 1:
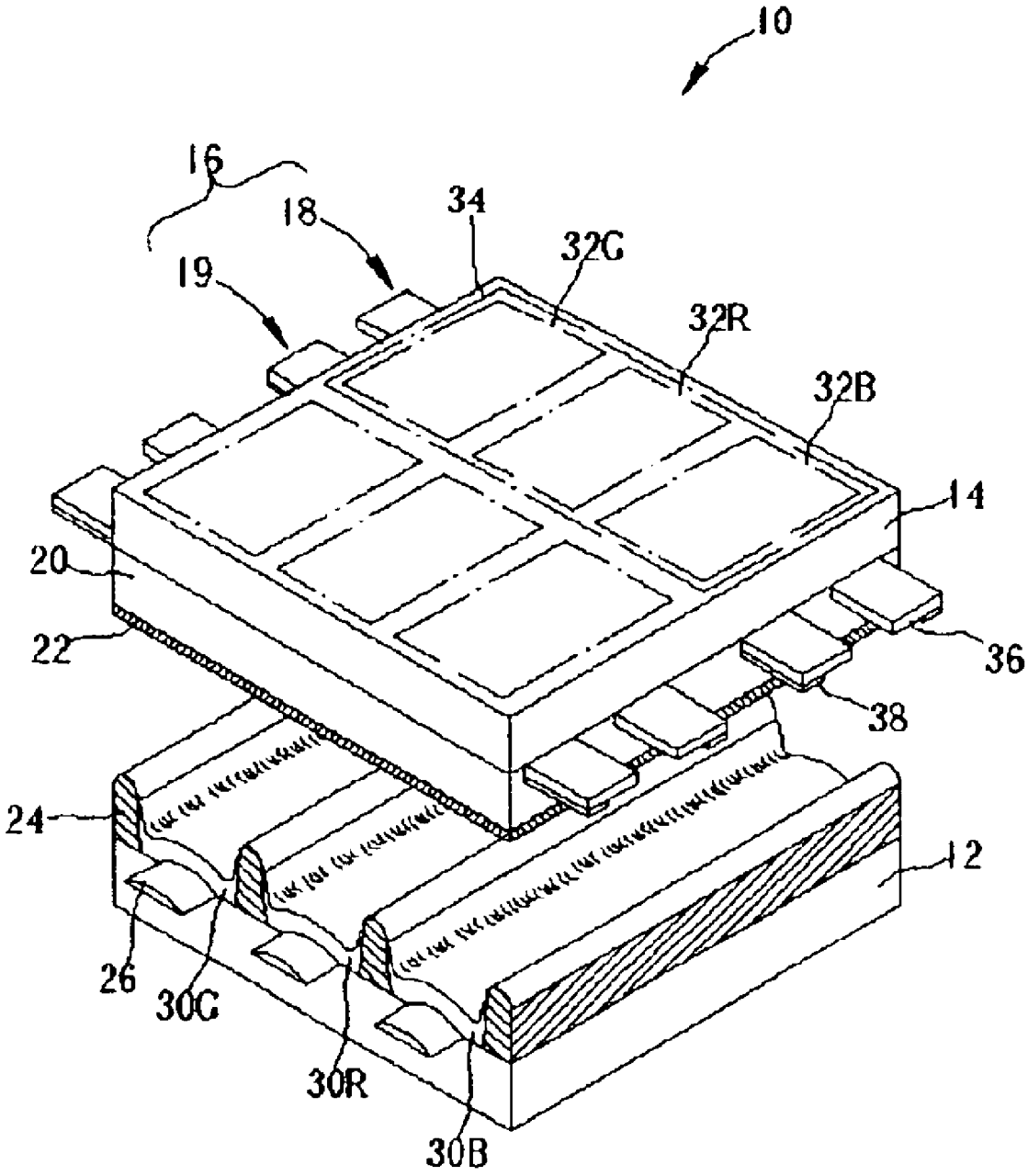
Fig. 1 Prior art
FIG. 1 is a schematic diagram of a plasma display panel according to a prior art.
Figure 2:
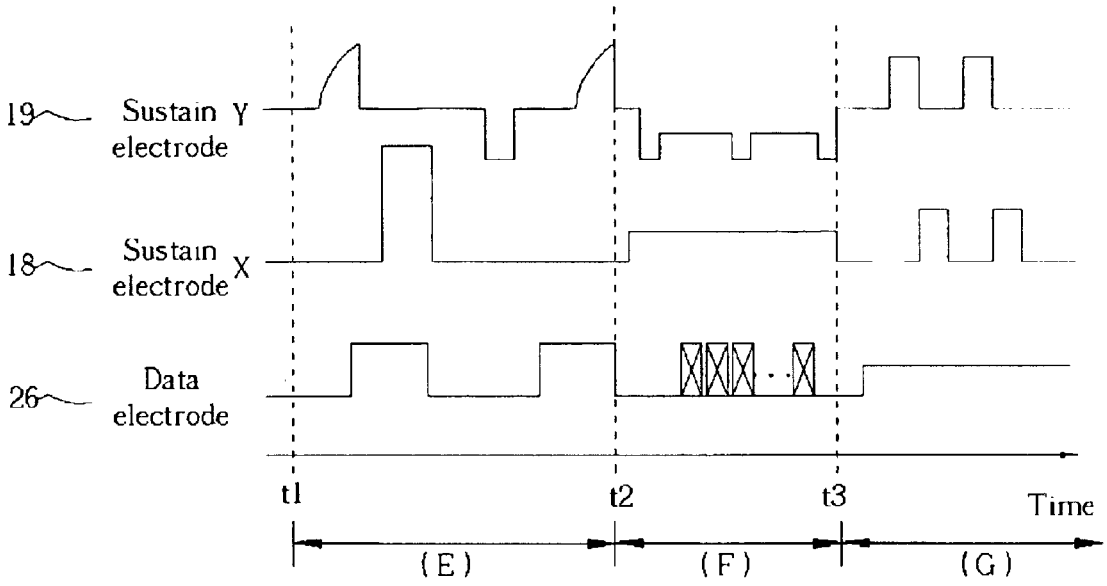
Fig. 2 Prior art
FIG. 2 is a time sequence diagram of driving the PDP in FIG. 1.
Figure 3:
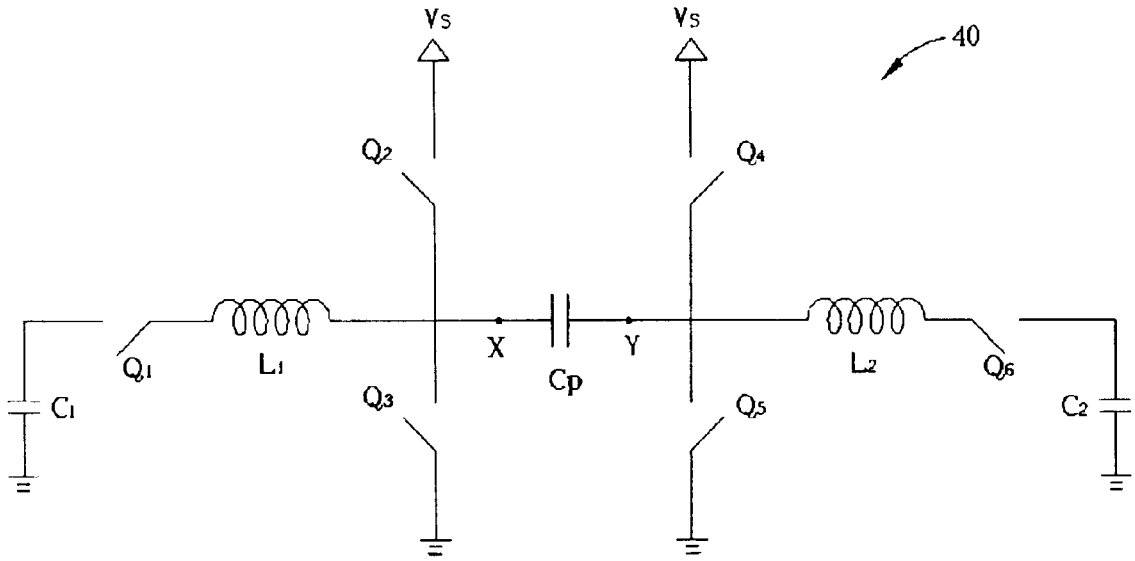
Fig. 3 Prior art
FIG. 3 is a schematic diagram of a driving circuit of the PDP in FIG. 1.
Figure 4:
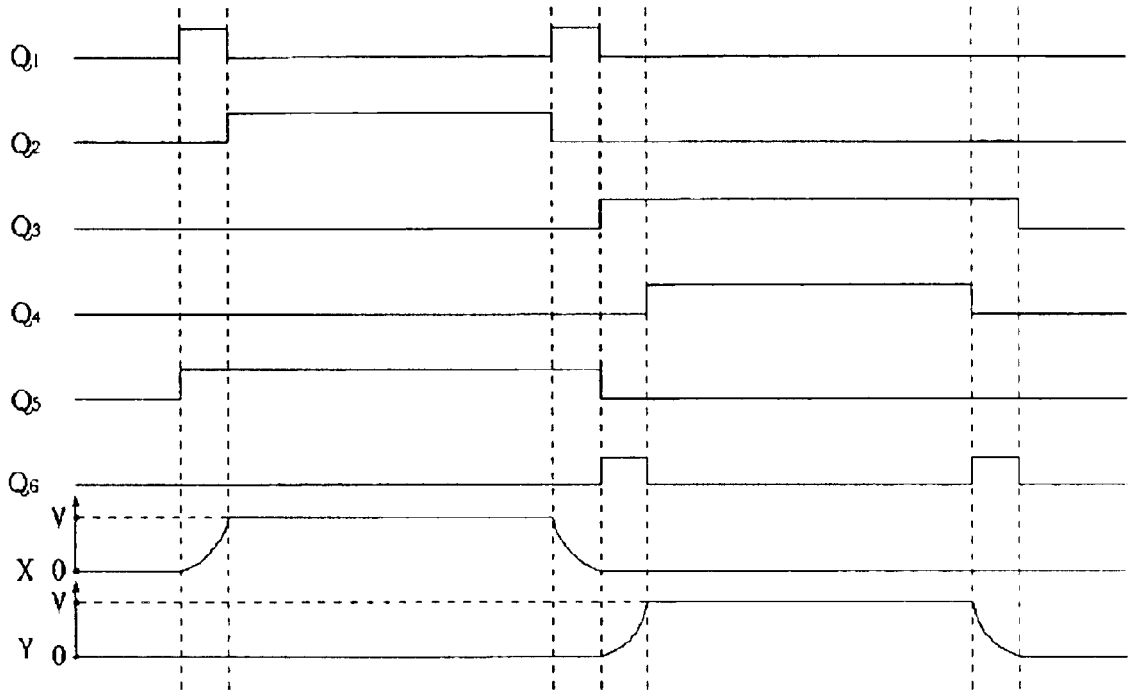
Fig. 4 Prior art
FIG. 4 is a time sequence diagram of a driving circuit in FIG. 3 during a sustain period.
Figure 5:
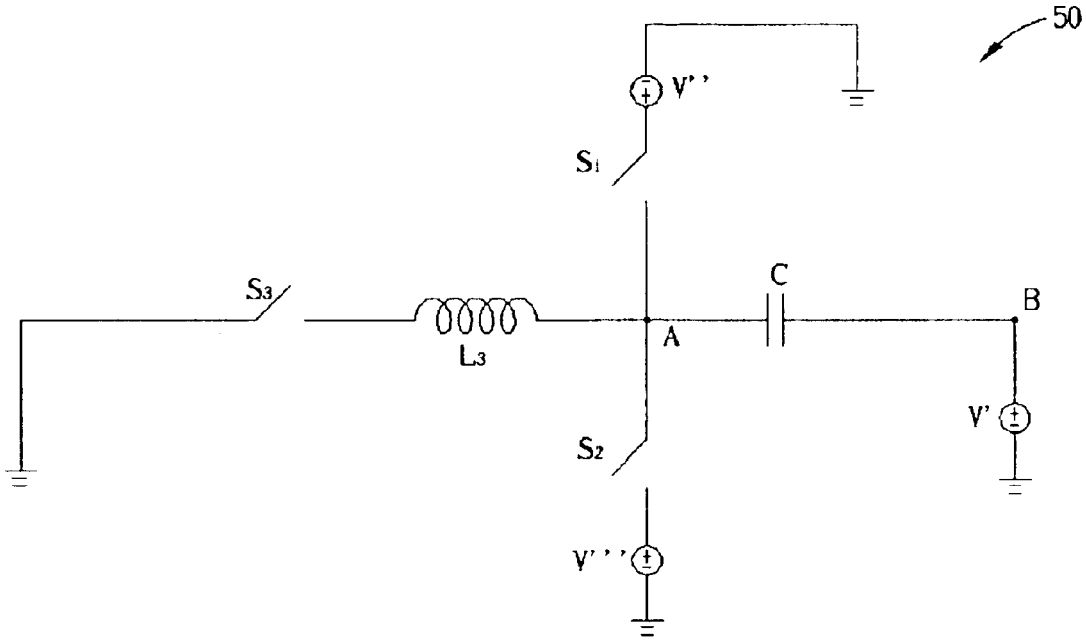
FIG. 5 is a schematic diagram of a first kind driving circuit 50 of a PDP according to the present invention.
Figure 6:
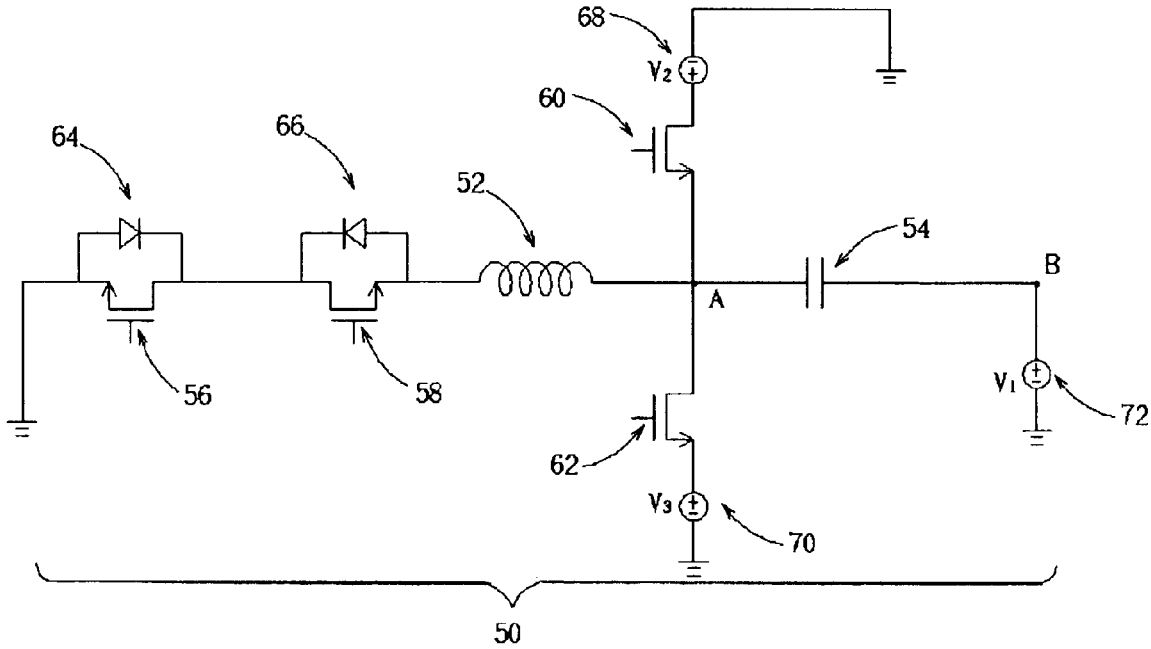
FIG. 6 is a schematic diagram of a first kind circuit of the driving circuit 50 shown in FIG. 5.

Please refer to FIG. 5. FIG. 5 is a schematic diagram of a first kind driving circuit 50 of a PDP according to the present invention. The driving circuit 50 comprises an inductor $L_3$, a capacitor C, switches $S_1$, $S_2$, $S_3$ and power supplies V", V"", V"""". Please refer to FIG. 6. FIG. 6 is a schematic diagram of a first kind circuit of the driving circuit 50 shown in FIG. 5. As shown in FIG. 6, the driving circuit 50 comprises an inductor 52, a capacitor 54, transistors 56, 58, 60, 62, diodes 64, 66, and power supplies 68, 70, 72. When electrical current pass through the inductor 52, the inductor 52 and the capacitor 54 form a resonance circuit. The transistors 56, 58, 60, 62 are switches for controlling the direction of electrical current. For example, when the transistor 60 is turned on, the power supply 68 can output electrical current passing through the transistor 60 and entering the capacitor 54. The diodes 64, 66 are body diodes of transistors 56, 58. In the present embodiment, diodes 64, 66 and transistors 56, 58 form a bi-directional switch for controlling the direction of electrical current. When the transistor 56 is turned on, the output electrical current from the inductor 52 passes through the diode 66 and the transistor 56, and flows into a grounding. Similarly, when the transistor 58 is turned on, the output electrical current from the grounding passes through the diode 64 and the transistor 58 and into the inductor 52. The power supplies 68, 70, and 72 supply a stable voltage for making the driving circuit 50 work. The power supply 72 supplies a first voltage $V_1$. The power supply 68 supplies a second voltage $V_2$, which is a positive voltage ($V_2$ volt). The power supply 70 supplies a third voltage $V_3$, which is a negative voltage ($V_3$ volt, and $V_3$ is a negative value). The power supply 72 supplies the sustain electrode 19 with the first voltage $V_1$, and the first voltage is a voltage ($V_1$ volt) between the second voltage and the third voltage ($V_3<V_1<V_2$). A circuit characteristic that can be viewed as a capacitor 54 is formed between the sustain electrodes 18, 19. Therefore, a point A of the capacitor 54 is the sustain electrode 18, and a point B of the capacitor 54 is the sustain electrode 19.

Figure 7:
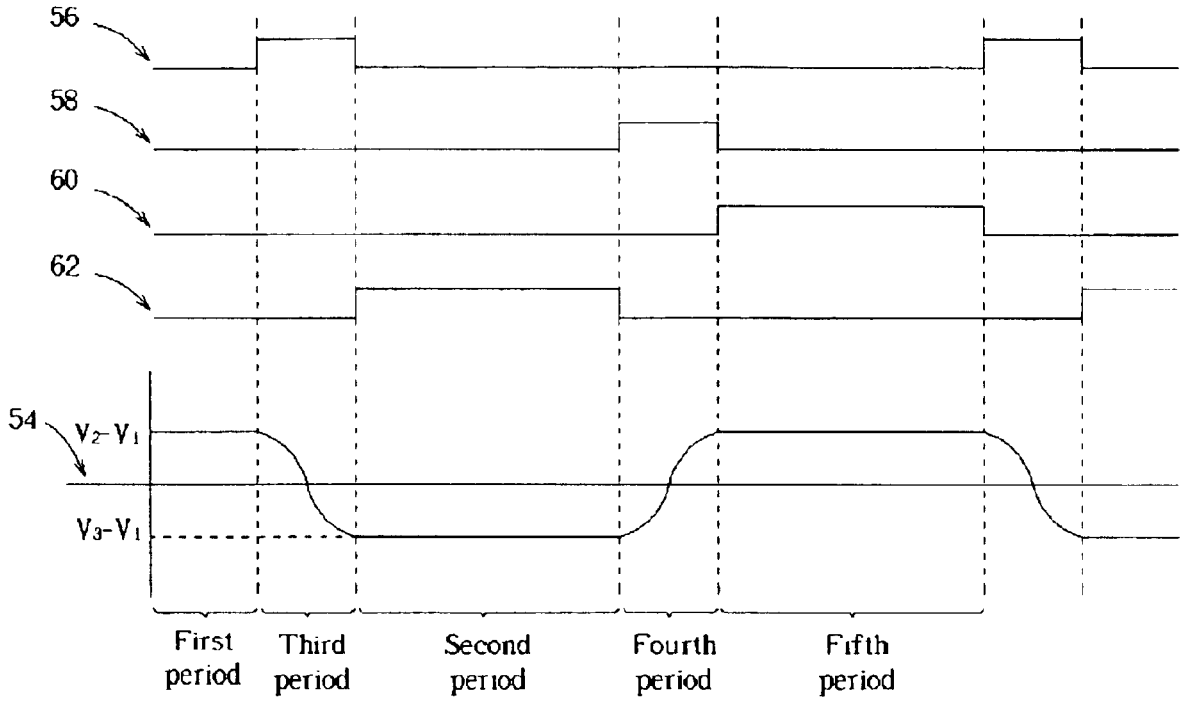
FIG. 7 is a time sequence diagram of the driving circuit 50 shown in FIG. 6 during a sustain period.
Figure 8:
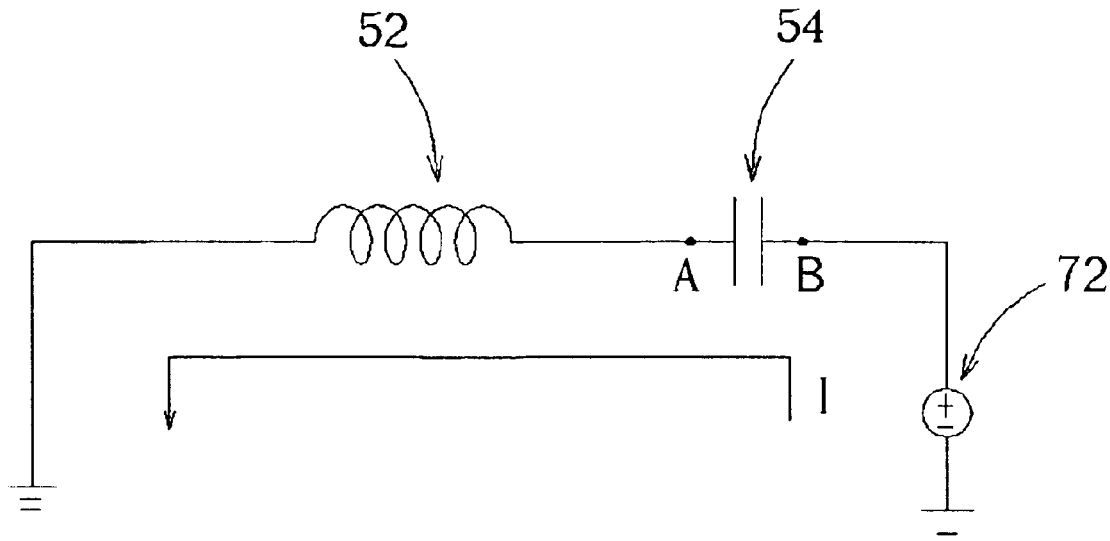
FIG. 8 and FIG. 9 are schematic diagrams of equivalent circuits of the driving circuit 50.
Figure 9:
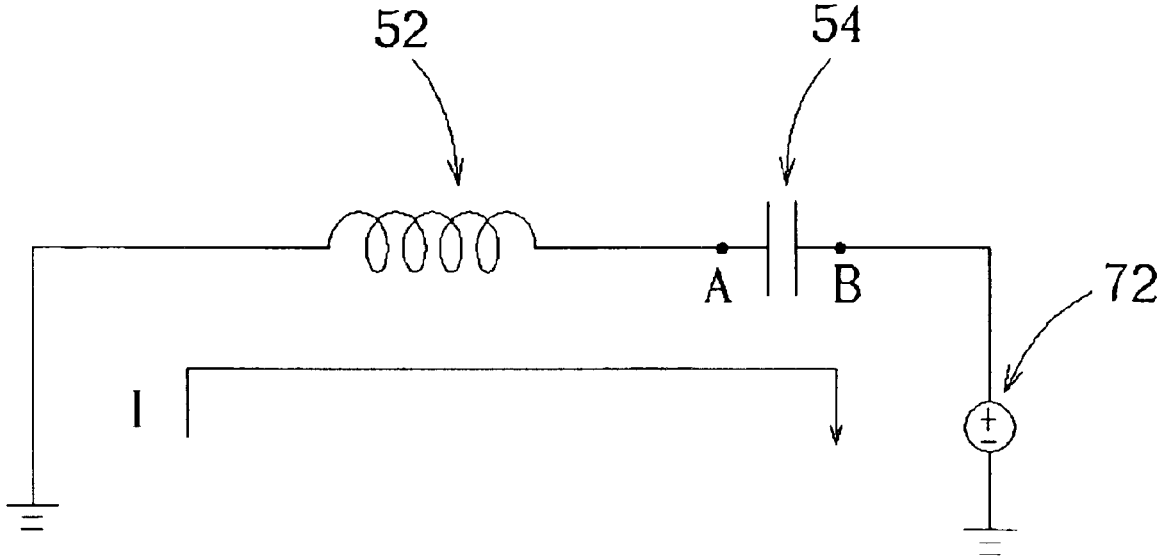

Please refer to FIG. 7 to FIG. 9. FIG. 7 is a time sequence diagram of the driving circuit 50 shown in FIG. 6 during a sustain period. FIG. 8 and FIG. 9 are schematic diagrams of equivalent circuits of the driving circuit 50. If the transistor 60 is the only transistor initially turned on, the voltage of the point A of the capacitor 54 is the second voltage ($V_2$ volt) supplied by the power supply 68, and the voltage of the point B of the capacitor 54 is the first voltage ($V_1$ volt) supplied by the power supply 72. Thus, the voltage difference between the two sides of the capacitor 54 is a first voltage difference $D_1$ which is equal to the second voltage minus the first voltage ($V_2-V_1$ volt), as shown in the first period of FIG. 7. Then, the transistor 60 is turned off and the transistor 56 is turned on. The capacitor 54 is now connected to the inductor 52. The capacitor 54 and the inductor 52 constitute a resonance circuit through the diode 66 and the transistor 56. An equivalent circuit of the resonance circuit is shown in FIG. 8. Therefore, the voltage difference between the two sides of the capacitor 54 oscillates from $V_2-V_1$ volt to $-(V_2-V_1)$ volt, wherein the voltage of the center of oscillation is the grounding voltage (zero volt) as shown in the third period of FIG. 7. That is, the amplitude of the oscillation of the resonance circuit is $(V_2-V_1)$ volt. Subsequently, the transistor 56 is turned off and the transistor 62 is turned on. The voltage of the point A of the capacitor 54 is held at a third voltage ($V_3$ volt) supplied by the power supply 70. Thus the voltage difference between the two sides of the capacitor 54 is a second voltage difference $D_2$, which is equal to the third voltage minus the first voltage ($V_3-V_1$ volt) and is a negative value, as shown in the second period of FIG. 7. At this time, the transistor 62 is turned off, the transistor 58 is turned on, and the capacitor 54 is connected to the inductor 52. The capacitor 54 and the inductor 52 constitute a resonance circuit through the diode 64 and the transistor 58. The equivalent circuit of the resonance circuit is shown in FIG. 9. Therefore, the voltage difference between the two sides of the capacitor 54 oscillates from $V_3-V_1$ volt to $-(V_3-V_1)$ volt, as shown in the fourth period of FIG. 7. Thereafter, the transistor 58 is turned off and the transistor 60 is turned on. The voltage of the point A of the capacitor 54 becomes the second voltage ($V_2$ volt) supplied by the power supply 68, and thus the voltage difference between the two sides of the capacitor 54 is held at $V_2-V_1$ volt, as shown in the fifth period of FIG. 7. Repeating the above-mentioned steps, a pulse is produced at the point A of the capacitor 54 in the driving circuit 50 according to the present invention. Although the voltage of the point B of the capacitor 54 is held at the first voltage ($V_1$ volt) through the power supply 72, the voltage difference between the sustain electrode 18 and the sustain electrode 19 can be varied by an oscillation of the voltage at the point A.

Figure 10:
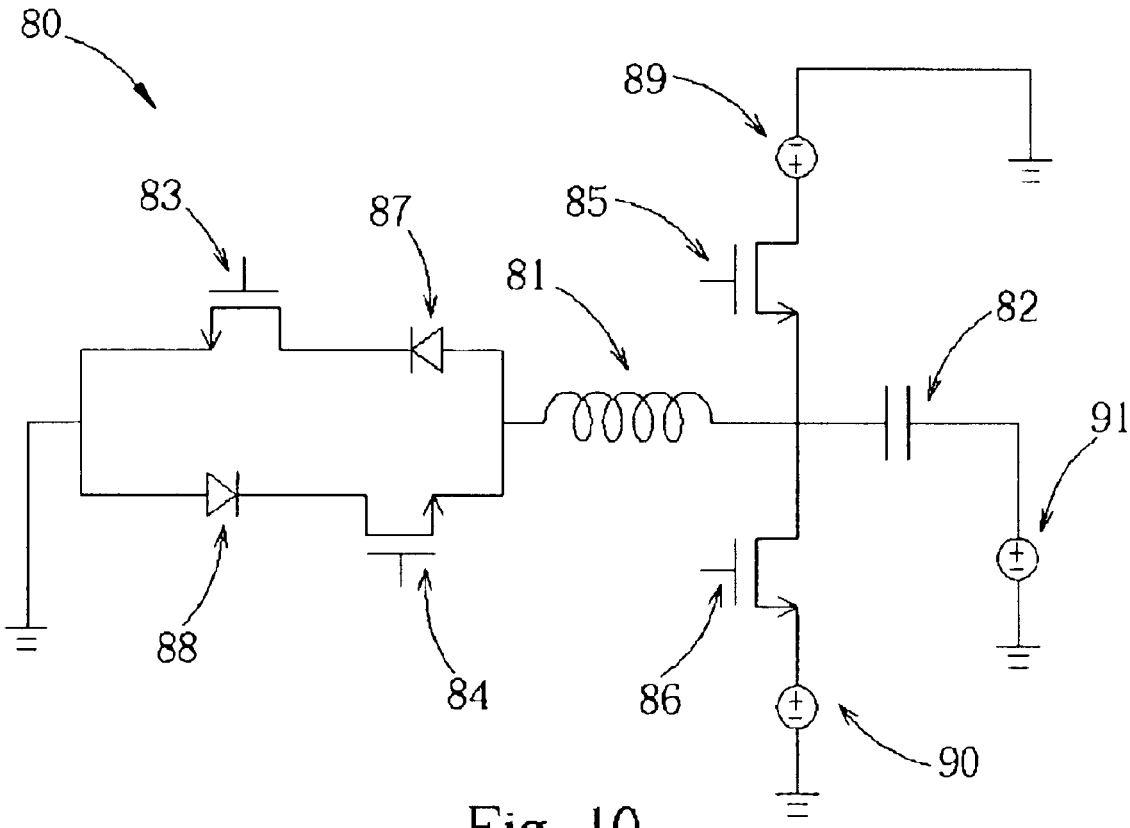
FIG. 10 is a schematic diagram of a second kind circuit of the driving circuit 50 shown in FIG. 5.

Please refer to FIG. 10 of a schematic diagram of a second kind circuit of the driving circuit 50 shown in FIG. 5. The driving circuit 80 comprises an inductor 81, a capacitor 82, transistors 83, 84, 85, 86, diodes 87, 88, and power supplies 89, 90, 91. The power supply 89 supplies a second voltage ($V_2$ volt), which is a positive value ($V_2>0$). The power supply 90 supplies a third voltage ($V_3$ volt), which is a negative value ($V_3<0$). The power supply 91 supplies a first voltage ($V_1$ volt) between the second voltage and the third voltage ($V_3<V_1<V_2$). The transistor 85 is a first switch $S_1$, and the transistor 86 is a second switch $S_2$. In addition, the diode 87 is connected to the transistor 83, and the diode 88 is connected to the transistor 84. A series of the diode 87 and the transistor 83, and a series of the diode 88 and the transistor 84 form a parallel circuit that is a third switch $S_3$ for controlling the direction of electrical current. The first voltage difference $D_1$ is equal to $V_2-V_1$ and the second voltage difference $D_2$ is equal to $V_3-V_1$. The voltage difference between the sustain electrode 18 and the sustain electrode 19 can be varied by oscillating the voltage of the point A, so that the voltage difference between the two sides of the capacitor 82 varies between the first voltage difference $D_1$ and the second voltage difference $D_2$. In the present embodiment, the driving waveforms of the voltage difference between the two sides of the capacitor 82 is the same as the driving waveforms of the voltage difference between the two sides of the capacitor 54 of the driving circuit 50 shown in FIG. 7.

Figure 11:
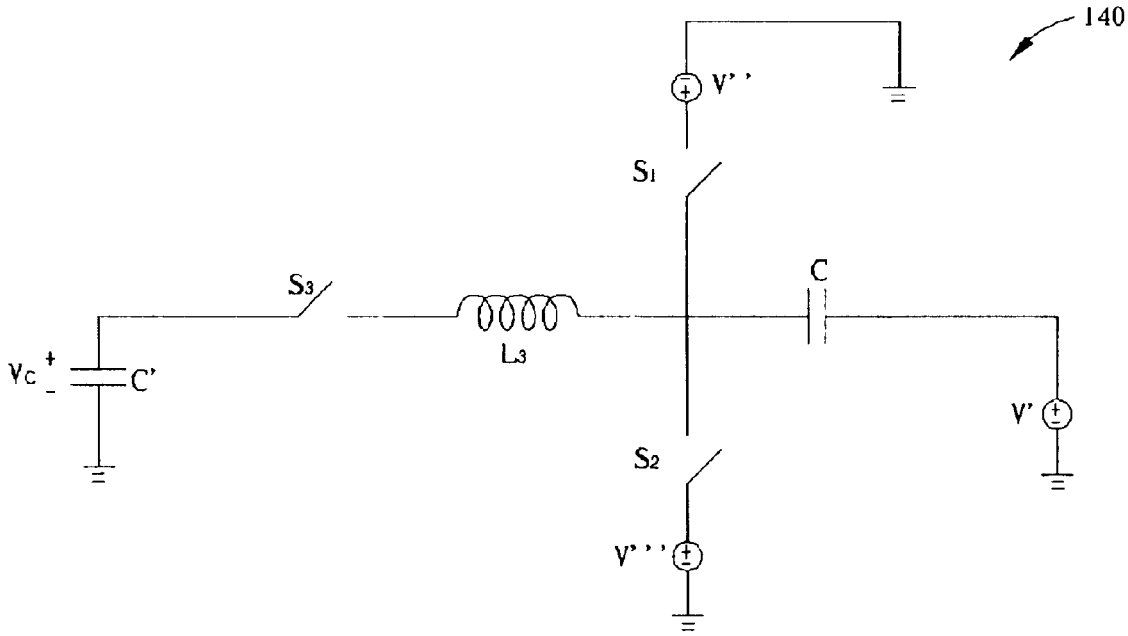
FIG. 11 is a schematic diagram of a second kind driving circuit 140 of a PDP according to the present invention.

Please refer to FIG. 5 and FIG. 11. FIG. 11 is a schematic diagram of a second kind driving circuit 140 of a PDP according to the present invention. As shown in FIG. 11, a capacitor C" is added in the driving circuit 50 of FIG. 5. A voltage difference $V_C$ between the two sides of the capacitor C" can be a positive value or a negative value. The voltage difference $V_C$ depends on the voltages V"", V"""" and the time-interval at which the switch $S_3$ is turned on. Thus, the voltage difference between the two sides of the capacitor 54 oscillates downwards from V""–V" volt to V""–V" volt, wherein the voltage of the center of oscillationis not the grounding voltage (zero volt). That is, the amplitude of the oscillation is not equal to (V""–V"–0) volt. Limitations of the voltages V"", V"""" are the same as those described in the above-mentioned embodiment.

Figure 12:
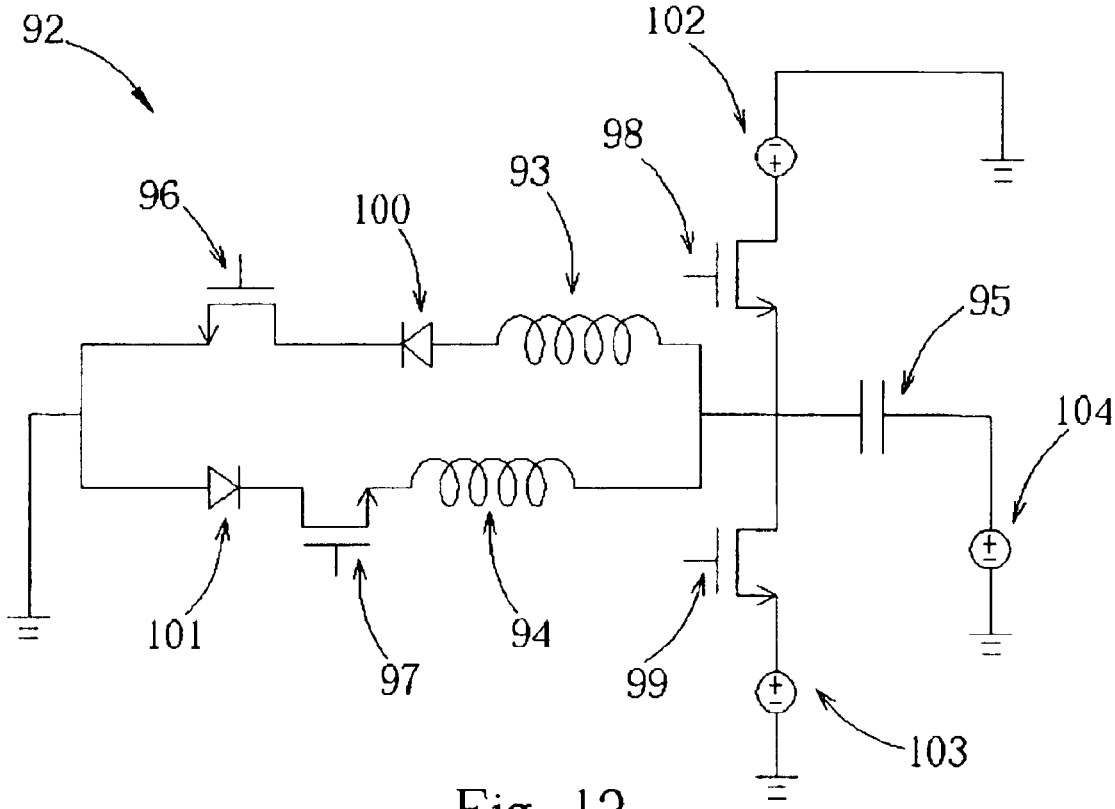
FIG. 12 is a schematic diagram of a third kind driving circuit 92 of a PDP according to the present invention.

Please refer to FIG. 12. FIG. 12 is a schematic diagram of a third kind driving circuit 92 of a PDP according to the present invention. The driving circuit 92 comprises inductors 93, 94, a capacitor 95, transistors 96, 97, 98, 99, diodes 100, 101, and power supplies 102, 103, 104. The power supply 102 supplies a second voltage ($V_2$ volt), which is a positive value ($V_2>0$). The power supply 103 supplies a third voltage ($V_3$volt), which is a negative value ($V_3<0$). The power supply 104 supplies a first voltage ($V_1$) between the second voltage and the third voltage ($V_3<V_1<V_2$). The transistor 98 is a first switch $S_1$, and the transistor 99 is a second switch $S_2$. The inductor 93, the diode 100, and the transistor 96 form a series circuit that can be a third switch $S_3$ (not shown here). Similarly, the inductor 94, the diode 101, and the transistor 97 form a series circuit that can be a fourth switch $S_4$ (not shown here). The series circuit of the inductor 93, the diode 100, and the transistor 96, and the series circuit of the inductor 94, the diode 101, and the transistor 97 form parallel circuits that can be a switch to control the direction of electrical current. The third switch $S_3$ causes the voltage difference between the two sides of the capacitor 95 to oscillate downwards from $V_2-V_1$ volt. The fourth switch causes the voltage difference between the two sides of the capacitor 95 to oscillate upwards from $V_3-V_1$ volt. Because different switches control the voltage difference between the two sides of the capacitor 95, the slope of the downward oscillation of the voltage difference can be different from the slope of the upward oscillation of the voltage difference. The first voltage difference $D_1$ is equal to $V_2-V_1$ volt, and the second voltage difference $D_2$ is equal to $V_3-V_1$ volt. The voltage difference between the sustain electrode 18 and the sustain electrode 19 can be varied by oscillating the voltage at the point A, so that the voltage difference between the two sides of the capacitor 95 varies between the first voltage difference $D_1$ and the second voltage difference $D_2$. In the present embodiment, the driving waveforms of the voltage difference between the two sides of the capacitor 95 is the same as the driving waveforms of the voltage difference between the two sides of the capacitor 54 of the driving circuit 50 shown in FIG. 7.

Figure 13:
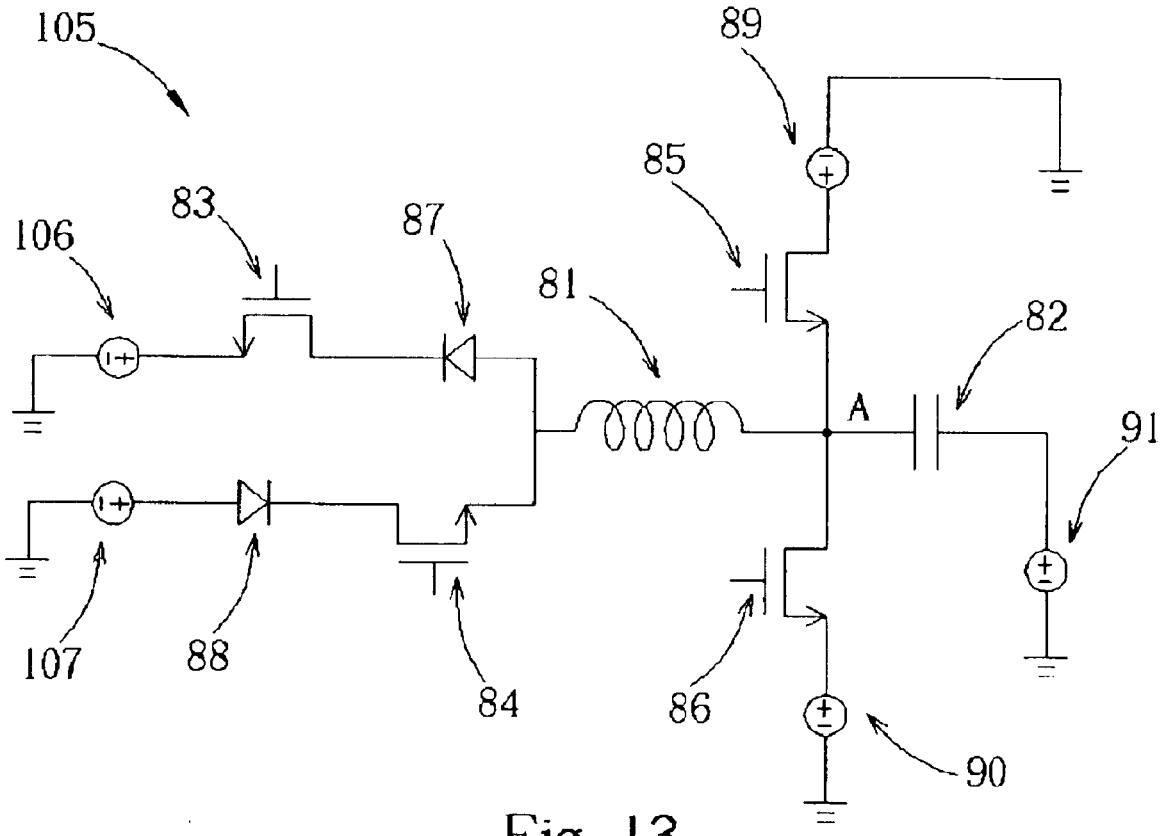
FIG. 13 is a schematic diagram of a fourth kind driving circuit 105 of a PDP according to the present invention.

Please refer to FIG. 13. FIG. 13 is a schematic diagram of a fourth kind driving circuit 105 of a PDP according to the present invention. The driving circuit 105 comprises an inductor 81, a capacitor 82, transistors 83, 84, 85, 86, diodes 87, 88, and power supplies 89, 90, 91, 106, 107. The power supply 89 supplies a second voltage ($V_2$ volt, $V_2>0$), which is positive, and the power supply 90 supplies a third voltage ($V_3$, $V_3<0$), which is negative. The power supply 91 supplies a first voltage ($V_1$) between the second voltage and the third voltage ($V_3<V_1<V_2$). The transistor 85 is a first switch S (not shown), and the transistor 86 is a second switch $S_2$ (not shown). The diode 87 and the transistor 83 form a series circuit that can be a third switch $S_3$ (not shown). Similarly, the diode 88 and the transistor 84 form a series circuit that can be a fourth switch $S_4$ (not shown). In the present embodiment, when transistor 85 of the driving circuit 105 is the only transistor turned on, the voltage at the point A of the capacitor 82 is held at a second voltage $V_2$ supplied by the power supply 89. Then, turning off the transistor 85 and turning on the transistor 83 forms a resonance circuit in the driving circuit 105. Because of the power supply 106, as the voltage at the point A of the capacitor 82 oscillates downward, the voltage of the center of oscillationis not the grounding voltage (zero volt). That is, the amplitude of the oscillation is not equal to ($V_2$–0) volt. Similarly, when transistor 86 of the driving circuit 105 is the only transistor turned on, the voltage at the point A of the capacitor 82 is held at a third voltage $V_3$ supplied by the power supply 90. Then, turning off the transistor 86 and turning on the transistor 84 forms a resonance circuit in the driving circuit 105. Because of the power supply 107, as the voltage at the point A of the capacitor 82 oscillates upward, the voltage of the center of oscillationis not the grounding voltage (zero volt). That is, the amplitude of the oscillation is not equal to –($V_3$–0) volt. In comparison with the driving circuit 80 shown in FIG. 10, which takes the grounding voltage as a center of the oscillation, the power supply 106 provides the voltage of the center of oscillation when the voltage at the point A of the capacitor 82 oscillates downwards in the present embodiment. Additionally, the power supply 107 supplies the voltage of the center of oscillation when the voltage at the point A of the capacitor 82 oscillates upwards in the present embodiment. As a result, the voltage at the point A of the driving circuit 82 does not take zero voltage as a center of the oscillation. The first voltage difference $D_1$ is equal to $V_2-V_1$ volt, and the second voltage difference $D_2$ is equal to $V_3-V_1$ volt. The voltage difference between the sustain electrode 18 and the sustain electrode 19 can be varied by oscillating the voltage at the point A, so that the voltage difference between the two sides of the capacitor 82 oscillates between the first voltage difference $D_1$ and the second voltage difference $D_2$.

Figure 14:
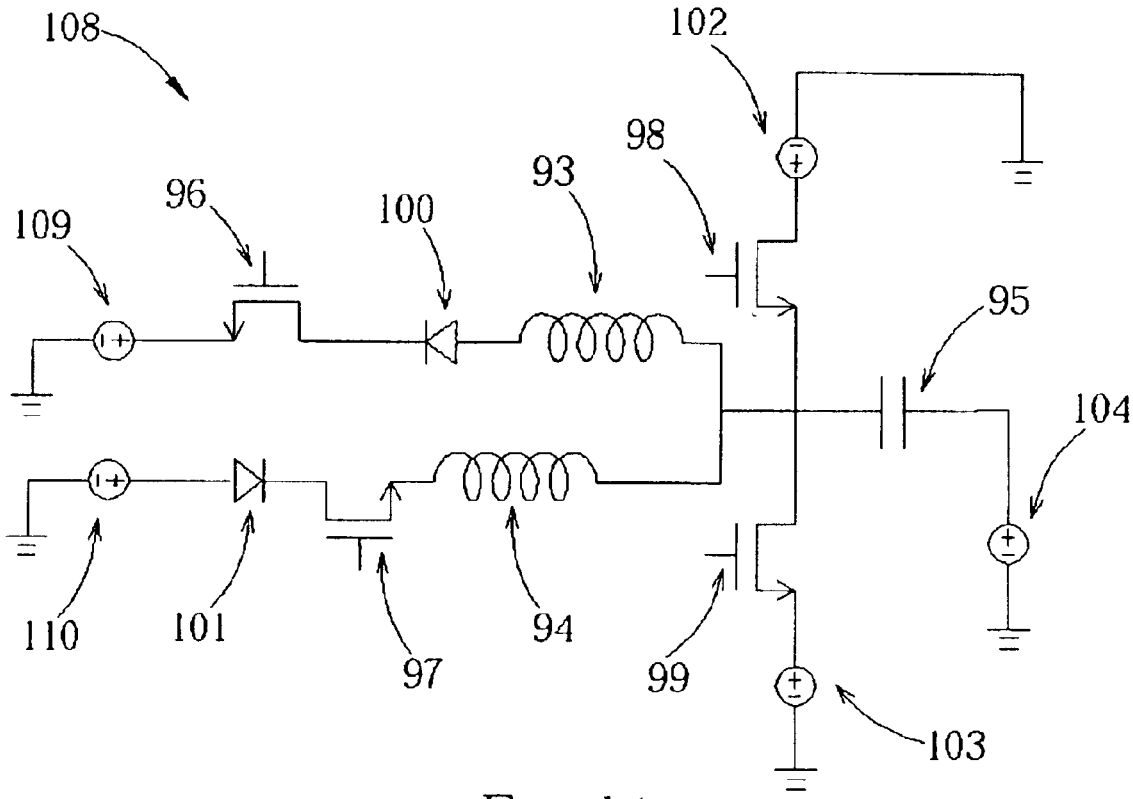
FIG. 14 is a schematic diagram of a fifth kind driving circuit 108 of a PDP according to the present invention.

Please refer to FIG. 14 of a schematic diagram of a fifth kind driving circuit 108 of a PDP according to the present invention. The driving circuit 108 comprises inductors 93, 94, a capacitor 95, transistors 96, 97, 98, 99, diodes 100, 101, and power, supplies 102, 103, 104, 109, 110. The power supply 102 supplies a second voltage ($V_2$ volt), which is a positive value ($V_2>0$). The power supply 103 supplies a third voltage ($V_3$), which is a negative value ($V_3<0$). The power supply 104 supplies, a first voltage ($V_1$) between the second voltage and the third voltage ($V_3<V_1<V_2$) The transistor 98 is a first switch, and the transistor 99 is a second switch. In addition, the inductor 93, the diode 100 and the transistor 96 form a series circuit that can be a third switch. Similarly, the inductor 94, the diode 101, and the transistor 97 form a series circuit that can be a fourth switch that controls the direction of electrical current. As disclosed in the driving circuit 105 of FIG. 13, the driving circuit 92 shown in FIG. 12 takes the grounding voltage as the center of the oscillation. However, the power supply 109 provides the voltage of the center of the oscillation when the voltage at the point A of the capacitor 95 oscillates downwards in the present embodiment. Similarly, the power supply 110 provides the voltage of the center of the oscillation when the voltage at the point A of the capacitor 95 oscillates upwards in the present embodiment. As a result, the voltage at the point A of the driving circuit 95 does not take zero voltage as the center of the oscillation. The first voltage difference $D_1$ is equal to $V_2-V_1$ volt, and the second voltage difference $D_2$ is equal to $V_3-V_1$ volt. The voltage difference between the sustain electrode 18 and the sustain electrode 19 can be varied by oscillating the voltage at the point A, so that the voltage difference between the two sides of the capacitor 95 oscillates between the first voltage difference $D_1$ and the second voltage difference $D_2$.

Figure 15:
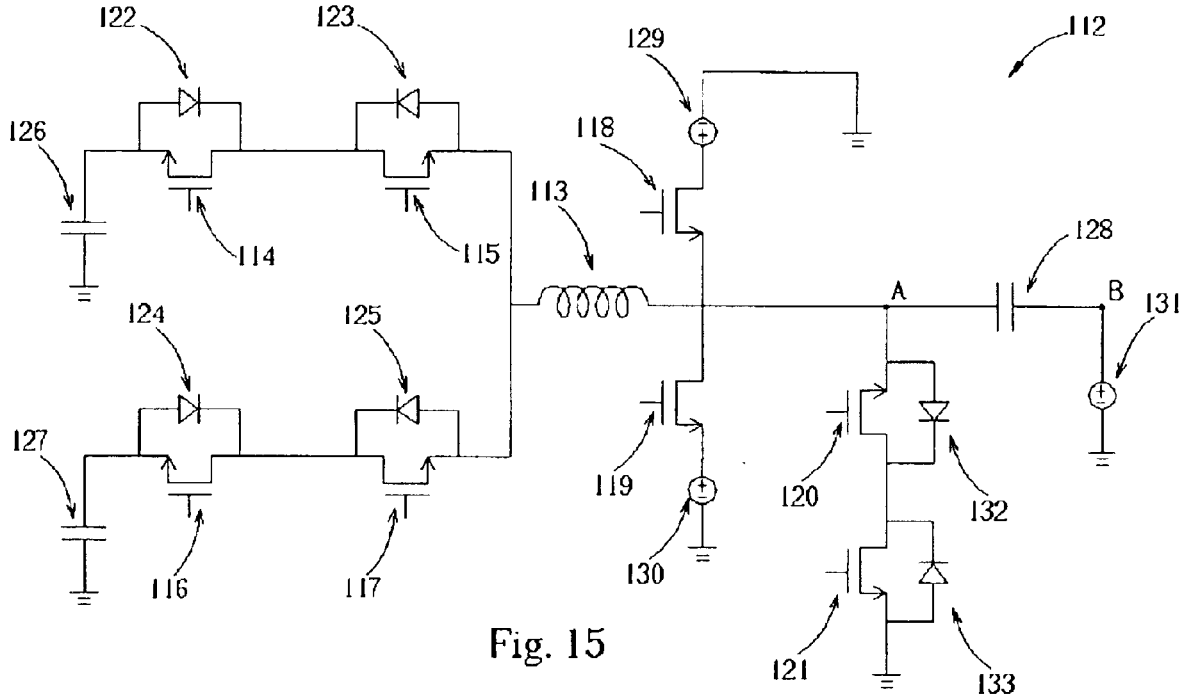
FIG. 15 is a schematic diagram of a sixth kind driving circuit 112 of a PDP according to the present invention.
Figure 16:
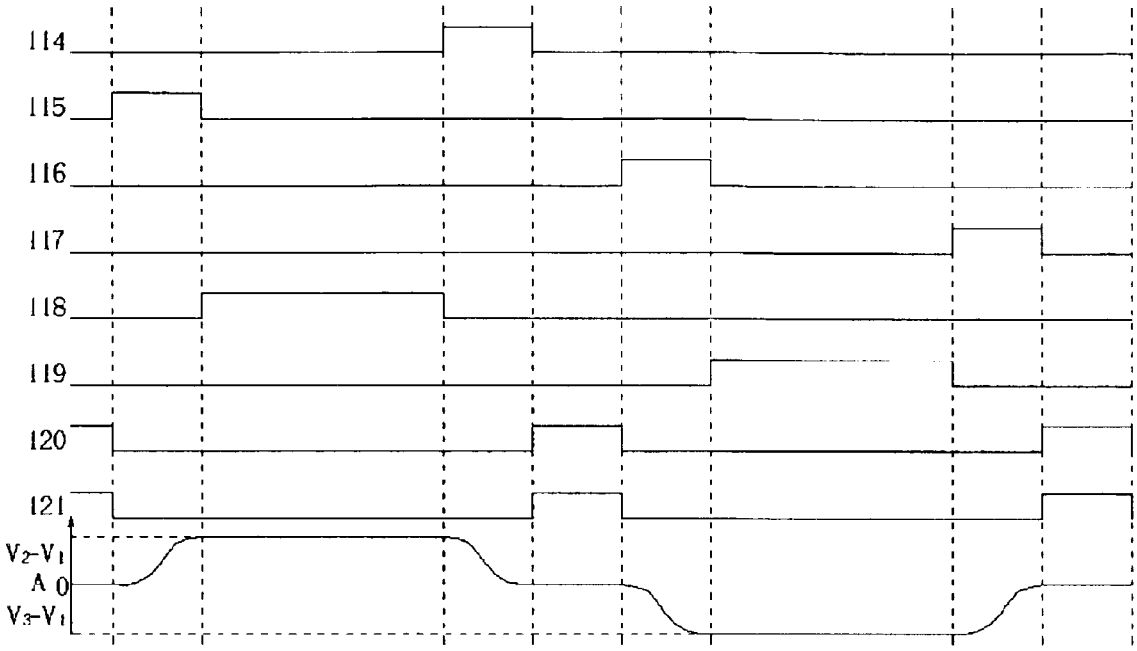
FIG. 16 is a time sequence diagram of the driving circuit 112 of FIG. 15.

Please refer to FIG. 15 and FIG. 16. FIG. 15 is a schematic diagram of a sixth kind driving circuit 112 of a PDP according to the present invention. FIG. 16 is a time sequence diagram of the driving circuit 112 of FIG. 15. The driving circuit 112 comprises an inductor 113, transistors 114, 115, 116, 117, 118, 119, 120, 121, diodes 122, 123, 124, 125, 132, 133, capacitors 126, 127, 128, and power supplies 129,130, 131. The diodes 122, 123, 124, 125, 132, 133 are body diodes of transistors 114, 115, 116, 117, 118, 119, 120, 121. The power supply 129 provides a second voltage ($V_2$ volt), which is a positive value ($V_2>0$). The power supply 130 provides a third voltage ($V_3$), which is a negative value ($V_3<0$). The power supply 131 supplies a first voltage ($V_1$) between the second voltage and the third voltage ($V_3<V_1<V_2$). In the present embodiment, the transistor 118 is a first switch, the transistor 119 is a second switch, the transistor 114 is a third switch, the transistor 117 is a fourth switch, the transistors 120 and 121 are a fifth switch, the transistor 115 is a sixth switch, and the transistor 116 is a seventh switch. As disclosed in the driving circuit 40 of the prior art PDP, when operating the resonance circuit, the voltage difference between the two sides of the capacitor 126 is equal to a half of the second voltage supplied by the power supply 129. The voltage difference between the two sides of the capacitor 127 is equal to a half of the third voltage provided by the power supply 130, preventing energy dissipation. In the present embodiment, the fifth switch (transistors 120 and 121) and the diodes 132 and 133 form a bi-directional switch. Therefore, the initial voltage at the point A of the capacitor 128 is equal to the grounding voltage. The voltage at the point A of the capacitor 128 can oscillate through a resonance circuit composed of the inductor 113, and the capacitors 126 and 127. During the voltage oscillations at the point A of the capacitor 128, the voltage at the point A of the capacitor 128 is held at the grounding voltage due to the bi-directional switch composed of the fifth switch (transistors 120 and 121) and the diodes 132 and 133. When the sixth switch (transistor 115) is turned on, the capacitor 128 and the inductor 113 form a resonance circuit so that the voltage at the point A of the capacitor 128 oscillates upwards from zero voltage. Turning on the seventh switch (transistor 116), the capacitor 128 and the inductor 113 form a resonance circuit so that the voltage at the point A of the capacitor 128 oscillates downwards from zero voltage. The first voltage difference $D_1$ is equal to $V_2-V_1$ volt, and the second voltage difference $D_2$ is equal to $V_3-V_1$ volt. The voltage difference between the sustain electrode 18 and the sustain electrode 19 can be varied by oscillating the voltage at the point A, so that the voltage difference between the two sides of the capacitor 128 oscillates between the first voltage difference $D_1$ and the second voltage difference $D_2$.

In comparison with the prior art during the sustain period, the present invention's driving method applies a constant voltage to one sustain electrode while a voltage oscillating with time is applied to another sustain electrode in each sub-pixel unit. The voltage difference between the sustain electrodes in each sub-pixel unit has a periodical variation. When the voltage difference between the sustain electrodes is larger than a discharging voltage, the ionized gas will discharge and emit ultraviolet light. Therefore, a single resonance circuit is used to produce driving waveforms on a single sustain electrode in the present invention. It does not require a second resonance circuit to produce driving waveforms on the second sustain electrode in the present invention. As shown in the driving circuit of the first embodiment of the present invention, the quantities of inductors and capacitors required by the resonance circuit are reduced. Thus, driving waveforms disclosed in the present invention differ from those in the prior art. In the present invention, the sustain electrodes can be driven to make the ionized gas discharge while requiring fewer electrical devices, reducing production cost. In addition, the driving method of the present invention can also be used during the reset period or the address period, making the reset and the address more efficient.

The above disclosure is based on the preferred embodiment of the present invention. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A driving method of a plasma display panel (PDP) device, the PDP device comprising a display panel being viewed as an equivalent capacitor, a first electrode and a second electrode; the driving method comprising:

supplying the first electrode with a first voltage;

supplying the second electrode with a second voltage during a first time-interval in which the second voltage is higher than the first voltage and a first voltage difference is equal to the second voltage minus the first voltage;

supplying the second electrode with a third voltage during a second time-interval in which the third voltage is lower than the first voltage and a second voltage difference is equal to the third voltage minus the first voltage; and providing the PDP device with a single inductor for making a voltage difference between the first electrode and the second electrode oscillate between the first voltage difference and the second voltage difference through a combination of the single inductor and the equivalent capacitor.

2. The driving method of claim 1 wherein the second voltage is positive, and the third voltage is negative.

3. The driving method of claim 1 wherein the PDP device further comprises:

a first power supply for supplying the first electrode with the first voltage;

a second power supply for supplying the second electrode with the second voltage;

a first switch electrically connected to the second electrode and the second power supply;

a third power supply for supplying the second electrode with the third voltage; and a second switch electrically connected to the second electrode and the third power supply;

the driving method further comprising:

turning on the first switch during the first time-interval for supplying the second electrode with the second voltage so that the voltage difference between the first electrode and the second electrode is held at the first voltage difference; and turning on the second switch during the second time-interval for supplying the second electrode with the third voltage so that the voltage difference between the first electrode and the second electrode is held at the second voltage difference.

4. The driving method of claim 3 wherein the PDP device further comprises a third switch electrically connected to the inductor; the driving method further comprising:

turning on the third switch during a third time-interval, which is between the first time-interval and the second time-interval, for making the voltage difference between the first electrode and the second electrode oscillate downwards from the first voltage difference.

5. The driving method of claim 3 wherein the PDP device further comprises a fourth switch electrically connected to the inductor;

the driving method further comprising:

turning on the fourth switch during a fourth time-interval, which is after the second time-interval, for making the voltage difference between the first electrode and the second electrode oscillate upwards from the second voltage difference.

6. The driving method of claim 5 wherein the PDP device further comprises a fifth switch electrically connected to the second electrode and a grounding;

the driving method comprising:

turning on the fifth switch for holding the voltage of the second electrode at a grounding voltage when the voltage of the second electrode reaches the grounding voltage.

7. The driving method of claim 6 wherein the PDP device further comprises a sixth switch electrically connected to the inductor;

the driving method further comprising:

turning on the sixth switch after the voltage of the second electrode is held at the grounding voltage for making the inductor and the equivalent capacitor generate an oscillation so that the voltage of the second electrode oscillates upwards from the grounding voltage.

8. The driving method of claim 6 wherein the PDP device further comprises a seventh switch electrically connected to the inductor;

the driving method further comprising:

turning on the seventh switch after the voltage of the second electrode is held at the grounding voltage for making the inductor and the equivalent capacitor generate an oscillation so that the voltage of the second electrode oscillates downwards from the grounding voltage.

9. A driving method of a plasma display panel (PDP) device, the PDP device comprising a display panel being viewed as an equivalent capacitor, a first electrode and a second electrode;

the driving method comprising:

(a) supplying the first electrode with a first voltage;

(b) supplying the second electrode with a second voltage during a first time-interval in which the second voltage is higher than the first voltage and a first voltage difference is equal to the second voltage minus the first voltage;

(c) supplying the second electrode with a third voltage during a second time-interval in which the third voltage is lower than the first voltage and a second voltage difference is equal to the third voltage minus the first voltage;

(d) providing the PDP device with a single inductor for making a voltage difference between the first electrode and the second electrode oscillate downwards during a third time-interval, which is between the first time-interval and the second time-interval, from the first voltage difference to the second voltage difference through an oscillation generated from a combination of the single inductor and the equivalent capacitor; and (e) utilizing the single inductor for making the voltage difference between the first electrode and the second electrode oscillate upwards during a fourth time-interval, which is after the second time-interval, from the second voltage difference to the first voltage difference through the oscillation generated from the combination of the single inductor and the equivalent capacitor.

10. The driving method of claim 9 wherein the second voltage is positive, and the third voltage is negative.

* * * * *